United States Patent [19]

Falguieres

[11] Patent Number: 4,646,633

[45] Date of Patent: Mar. 3, 1987

[54] DOUBLE PISTON ALTERNATING ACTION PRESSING APPARATUS

[76] Inventor: Hubert Falguieres, Quartier des Fourques, 13510 Eguilles, France

[21] Appl. No.: 729,199

[22] Filed: May 1, 1985

[30] Foreign Application Priority Data

May 4, 1984 [FR] France ..... 84 07081

[51] Int. Cl.[4] ..... B30B 13/00; B30B 9/06

[52] U.S. Cl. ..... 100/37; 100/116; 100/127; 100/179; 100/295

[58] Field of Search ..... 100/295, 116, 126, 127, 100/179, 37

[56] References Cited

U.S. PATENT DOCUMENTS 3,550,775 12/1970 Cooley ..... 100/127 X
3,621,775 11/1971 Dedio et al. .
3,802,337 4/1974 St-Hiliare ..... 100/179 X
3,854,397 12/1974 Dempster ..... 100/295 X
4,158,332 6/1979 Melandri ..... 100/116 X
4,303,412 12/1981 Baikoff ..... 100/127 X

FOREIGN PATENT DOCUMENTS 571102 2/1933 Fed. Rep. of Germany .
1546441 11/1968 France .
2053343 4/1971 France .

*Primary Examiner*—Peter Feldman
*Attorney, Agent, or Firm*—Sandler & Greenblum

[57] ABSTRACT

The invention relates to a double piston and alternating action press apparatus. The device according to the present invention is constituted by the combination of a rapid advance feed piston and a second telescopic piston having a slow and stepwise advance. The device is adapted to exert an adjustable pressure on various products and more particularly, grapes, to extract the juice without grinding the grapes and seeds.

13 Claims, 4 Drawing Figures

DOUBLE PISTON ALTERNATING ACTION PRESSING APPARATUS

BACKGROUND OF INVENTION

Technological Background

The object of the invention relates to a press apparatus having a double piston and alternating action.

It is adapted to exert an adjustable pressure on various products and more particularly grapes, to extract the juice without grinding the bunches, or stems and seeds.

Until the present time, grape presses have generally been utilized which include a helical screw shaft and a blocker so as to avoid having the grapes turn with the screw. However in these types of presses, the blocker, by rubbing on the helical screw, causes the grapes to be crushed with the grinding of the bunches and the seeds.

SUMMARY OF THE INVENTION

The apparatus according to the invention overcomes these disadvantages by replacing the compression screw by a double piston system which makes it possible to modulate the pressure in rapid sequence and in slow sequence by successive impulses with pressure on the assembly of the mass uniformly distributed over all of the surfaces.

The apparatus according to the present invention is constituted by the combination of a rapid advancement feed piston and a second telescopic piston having low and stepwise advance.

BRIEF DESCRIPTION OF THE DRAWINGS

In the annexed drawings, given by way of non-limiting example, one embodiment of the object of the invention is shown as follows.

DETAILED DESCRIPTION OF THE PREFERRED EMBODIMENT

Figure 1:
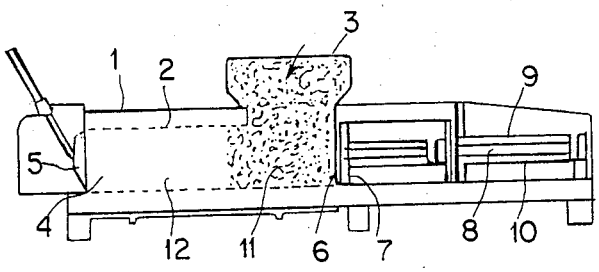
FIG. 1 illustrates the apparatus seen in its entirety in elevation and in longitudinal cross-section.

The horizontal presser, as shown in FIG. 1, is constituted by a sealed container 1 within which is concentrically positioned the perforated cylindrical cage 2. This cylindrical cage 2 is directly connected to the charging funnel 3. It is blocked at its rear portion 4 by a pivotable door 5 and at its front portion by the double plate pressure piston 6, 7.

Plate 6 is mounted at the end of the telescopic shaft 8 of double action jack 9. Double action jack 9 includes double shaft 8, 10, which performs the first push on the grapes by means of plates 6 and 7 connected to one another. The second push on the grapes is performed by shaft 8 and plate 6.

Grapes are fed into press 2 by the funnel 3. The grapes fall into the feed chamber 11. Thereafter, under the effect of rapid advance piston 9, the grapes are brought into pressure chamber 12, as shown in FIG. 2.

Figure 2:
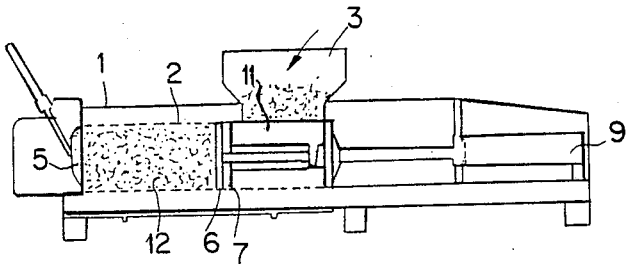
FIGS. 2, 3 and 4 illustrate the various phases of the pressure cycle according to the present invention.
Figure 3:
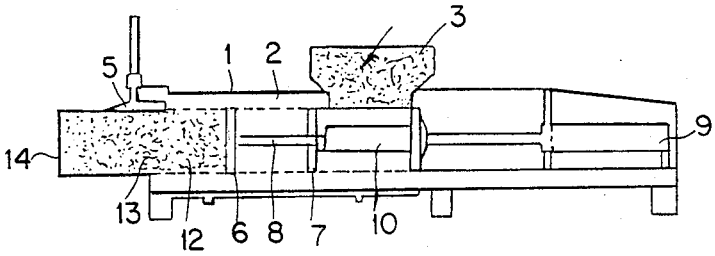
Figure 4:
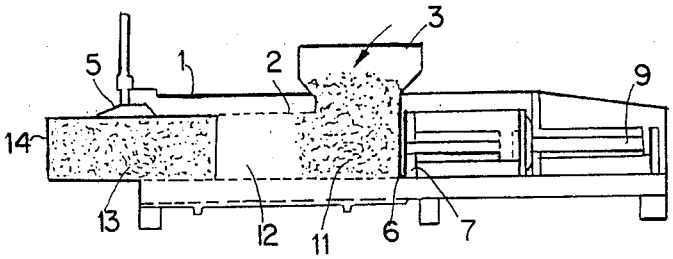

As the piston advances, as shown in FIGS. 2 and 3, chamber 11 is blocked. The grapes are stored in funnel 3 which has a large capacity.

When rapid advance piston 9 reaches the end of its stroke, piston 10 and plate 6 are brought into action. Piston 10 and plate 6 are moved according to a cycle which comprises a slow and stepwise advance with slight retreat on each impulse to apply pressure to, or compress, the grapes and activate the flow of the juices.

Then the drained grapes are evacuated through door 5 by forming stopper 13.

Pistons 9 and 10 retract rapidly thus creating a vacuum in sector 12 of the pressure chamber. They allow, by opening of the feed chamber 11, the grapes to fall therein, while sector 14 of the stopper is evacuated.

The press is ready for a new cycle and returns to phase 1.

Door 5 remains open, the stopper 13 being able to furnish a sufficiently strong counterpressure to assure the extraction of the juices. However, one can modulate its closure to adjust the evacuation of the pressed grapes or to regulate the resistance force.

The pressure exerted by plates 6, 7 and telescopic shafts 10, 8 assure a complete and total extraction of the juices without grinding of the bunches, or stems, or of the seeds, or even tearing the ligneous portions.

The uniformly distributed pressure integrally, or completely drains the pulps; the compact and dry stopper, leaves at a rapid flow adapted to the feed sequences.

However, the configurations, dimensions and arrangements of the various elements may vary within the limit of equivalences as well as the materials utilized for their manufacture, without changing the general concept of the invention which has just been described.

I claim:

1. A double piston and alternating action press apparatus adapted to extract juice from grapes without grinding any stems or seeds, said apparatus comprising:

(a) a sealed container having a cylindrical cage;

(b) a funnel for feeding said grapes into a feed chamber in said cylindrical cage;

(c) at least two pressure plates for applying pressure to said grapes in said feed chamber;

(d) a double action jack for moving said at least two pressure plates toward said grapes, said double action jack comprising at least two telescopic shaft connected to said at least two pressure plates, wherein said jack is operated such that pressure is applied by a rapidly advancing movement followed by a slowly advancing movement followed by a rapid retraction creating a vacuum in said cylindrical cage, wherein said feed chamber is alternately blocked and opened by said jack.

2. The apparatus according to claim 1 further comprising a door pivotably attached to a rear end of said cylindrical cage for blocking said rear end, said door forming an adjustable opening.

3. The apparatus according to claim 1 wherein said cylindrical cage comprises two adjacent sections, and said funnel opens into one of said sections which forms said feed chamber and another of said sections forms a pressure chamber.

4. The apparatus according to claim 1 wherein a first of said at least two pressure plates is moved rapidly to apply pressure to said grapes and subsequently, a second of said at least two pressure plates is stepped forward slowly, with small backward movements, to form a stopper at the end of a stroke and to cause the discharge of said grapes at an outlet of said cylindrical cage.

5. A double action piston pressing apparatus for extracting juice from a product comprising:

(a) a sealed container having an opening;

(b) a cylindrical cage positioned within said sealed container;

(c) means for feeding said product through said opening into said cylindrical cage;

(d) at least two pistons for pressing said product to extract said juice, said at least two pistons comprising a feeding piston adapted to move rapidly through said cylindrical cage in rapid strokes towards said product and a compression piston adapted to move in slow, stepped strokes toward said product, each step of the slow, stepped strokes including a backwards motion, wherein said at least two pistons move in substantially the same direction towards said product during said rapid and slow strokes for compressing said product; and (e) at least two flat pressure plates connected to one end of each of said at least two pistons which come into contact with said product for applying a uniform pressure to said product.

6. The pressing apparatus according to claim 5 wherein said product comprises grapes and said cylindrical cage is positioned substantially concentrically within said sealed container.

7. The pressing apparatus according to claim 5 wherein said compression piston is positioned substantially concentrically within said feeding piston.

8. The pressing apparatus according to claim 5 wherein said cylindrical cage is of substantially uniform diameter along its entire length.

9. The pressing apparatus according to claim 5 wherein said cylindrical cage comprises a front end in which said at least two pistons are positioned in their retracted position, a middle portion into which the product is fed by said means for feeding and a rear portion toward which said product is pushed, each of said front portion, said middle portion and said rear portion having substantially the same diameter.

10. The pressing apparatus according to claim 9 further comprising a pivotable door mounted at said rear portion for alternately opening and blocking said rear portion, wherein the size of the opening defined by said door is adjustable, and wherein said door pivots into an open position as said compression piston compresses said product.

11. The pressing apparatus according to claim 5 wherein said cylindrical cage comprises a plurality of openings and juice extracted from said product passes through said plurality of openings.

12. The pressing apparatus according to claim 5 wherein upon completion of their respective strokes, said feeding piston and said compression piston retract rapidly for creating a substantial vacuum in said cylindrical cage.

13. A method of operating a double action piston pressing apparatus, said apparatus comprising a sealed container, a cylindrical cage positioned within said sealed container comprising a feeding chamber and a compression chamber adjacent to one another, said apparatus further comprising at least two pressing plates for applying pressure to a product to extract juice therefrom, means for feeding said product into said cylindrical cage, a feeding piston for moving said product towards a rear of said cylindrical cage, a compression piston for compressing said product to extract said juice, a first flat pressure plate connected to said feeding piston and a second flat pressure plate connected to said compression piston, said method comprising the steps of:

(a) feeding a mass of said product into said cylindrical cage;

(b) moving said feeding piston towards said rear of said cylindrical cage in a rapid stroke for feeding said product from said feeding chamber into said compression chamber and applying a uniform pressure on said product via said first flat pressure plate;

(c) moving said compression piston in substantially the same direction as said feeding piston, in a slow, stepped stroke for compressing said product within said compression chamber wherein said slow stroke includes small spaced movements in an opposite direction to activate the flow of said juice, wherein said second flat pressure plate applies uniform pressure on said product; and (d) rapidly retracting said feeding piston and said compression piston for creating a substantial vacuum within said cylindrical cage.

* * * * *

UNITED STATES PATENT AND TRADEMARK OFFICE

CERTIFICATE OF CORRECTION

PATENT NO. : 4,646,633

DATED : March 3, 1987

INVENTOR(S) : Hubert FALGUIERES

It is certified that error appears in the above-identified patent and that said Letters Patent is hereby corrected as shown below:

At column 2, line 40 (i.e., in claim 1, line 11) change "shaft" to ——shafts——.

Signed and Sealed this

Twenty-fifth Day of December, 1990

*Attest:*

HARRY F. MANBECK, JR.

*Attesting Officer*

*Commissioner of Patents and Trademarks*